United States Patent [19]

Chen

[11] 4,276,829

[45] Jul. 7, 1981

[54] MECHANO-ELECTROSTATIC CHARGE-IMAGING METHOD AND APPARATUS

[76] Inventor: Wu Chen, 26 W. Ridge Pike, Royersford, Pa. 19468

[21] Appl. No.: 77,285

[22] Filed: Sep. 20, 1979

Related U.S. Application Data

[63] Continuation-in-part of Ser. No. 873,900, Jan. 31, 1978, abandoned, which is a continuation-in-part of Ser. No. 683,429, Dec. 8, 1975, abandoned, which is a continuation-in-part of Ser. No. 469,522, May 13, 1974, abandoned, which is a continuation-in-part of Ser. No. 311,532, Dec. 4, 1972, abandoned.

[51] Int. Cl.[3] ..... G03G 15/22

[52] U.S. Cl. ..... 101/426; 101/DIG. 13; 101/1; 346/153.1; 346/155; 430/31; 430/35; 430/48; 430/55; 427/13; 355/3 CH

[58] Field of Search ..... 101/426, 1 R, DIG. 13; 346/153, 155, 156; 427/12, 13, 27; 307/88 ET; 430/31, 32, 33, 35, 36, 42, 48, 50, 51, 55, 101; 355/3 CH, 4, 9, 12

[56] References Cited

U.S. PATENT DOCUMENTS

| | | | |
|---|---|---|---|
| 2,953,470 | 9/1960 | Green et al. | 101/DIG. 13 |
| 3,108,894 | 10/1963 | Stowell | 101/DIG. 13 |
| 3,206,600 | 9/1965 | Gold | 427/27 X |
| 3,354,464 | 11/1967 | Tsukatani et al. | 346/153 X |
| 3,414,723 | 12/1968 | Pleitt et al. | 260/348 R |
| 3,443,517 | 5/1969 | Gundlach | 101/219 |
| 3,596,282 | 7/1971 | Stengenga | 346/153 |
| 3,609,238 | 9/1971 | Hodel | 346/153 X |
| 3,673,603 | 6/1972 | Brock | 346/153 |
| 3,693,181 | 9/1972 | Marshall et al. | 346/153 |
| 3,774,229 | 11/1973 | Blackwood et al. | 346/153 X |
| 3,787,722 | 1/1974 | Hatsell | 346/153 |
| 3,811,766 | 5/1974 | Robinson, Jr. | 346/153 |
| 3,826,915 | 7/1974 | Giolitti et al. | 346/153 X |
| 3,861,940 | 1/1975 | Forgo et al. | 101/DIG. 13 |
| 3,896,451 | 7/1975 | Omi | 346/153 |
| 3,897,247 | 7/1975 | Schadlich | 346/153 X |
| 3,900,586 | 8/1975 | Wright | 427/19 |
| 3,931,417 | 1/1976 | Wright | 427/19 |

OTHER PUBLICATIONS

"Contact Electrostatic Printing", McCurry, IBM Tech. Discl. Bulletin, vol. 13, No. 10, Mar. 1971, pp. 3117–3118.

*Primary Examiner*—E. H. Eickholt

[57] ABSTRACT

The method of forming a charge-image on a charge-retaining object by applying an electrical image-activating energy and a mechanical image-activating energy in a manner to result in the functional dependence of the charge density of the consequent charge-image to the magnitudes of the image-activating energies and to the length of the activating time period, enabling the charge-image or the subsequent visible image to have a uniform desired level of desired density, controlled multiple levels of density, controlled continuously varying density, or a combination thereof. It also enables the trading off of charge density for a lower image-activating voltage and the trading off of charge-imaging speed for higher charge density. The resulting image is of high fidelity to the original. The simultaneous application of electrical and mechanical image-activating energies further provides the option of applying the electrical image-activating energy to only one side of the imaging object for the formation of the charge-image. One advantage of such an operating option is the removal of the restriction as to the cross-sectional geometry and to the thickness of the imaging object. Apparatus examplifying the embodiment of the invention are given.

24 Claims, 19 Drawing Figures

MECHANO-ELECTROSTATIC CHARGE-IMAGING METHOD AND APPARATUS

BACKGROUND OF THE INVENTION

This is a continuation in part of application Ser. No. 873,900 filed Jan. 31, 1978, which is a continuation in part of application Ser. No. 683,429, filed Dec. 8, 1975, which is in turn a continuation in part application Ser. No. 469,522, filed May 13, 1974, which is in turn a continuation in part of application Ser. No. 311,532, filed Dec. 4, 1972. All these parent applications are now abandoned.

This invention relates to the formation of charge-image to a charge-retaining object and more particularly relates to a method and apparatus for a new mode of operation in the field of charge-image formation, which has distinctive beneficial features heretofore unobtainable from, and unknown to, the prior arts. These features include the ability to set the charge density of the consequent image at any one of a wide range of levels, to vary the level of charge density at will, to trade-off charge-density for lower image-activating voltage or to trade off imaging speed for higher charge density, for optimum design of equipment, to obtain charge-image of high fidelity, and to provide a new option for equipment configuration wherein the electrical image-activation can be applied to only one side of the charge-retaining medium in addition to the conventional option wherein the electrical image-activation is applied to both sides of the medium. The resulting charge-image or the pattern of the charge-images can be used for electrostatic detection or subsequently further processed for visual, thermal, magnetic, or other means of detection.

There is a rather long history and a variety of methods in applying electrostatic energy for the purpose of forming detectable images. Broadly speaking, there are three categories of approaches in doing so.

The first is the material-transfer approach whereby an inking material is transferred by the electrostatic force from a shaped electric field onto the surface of a recording medium, such as described in the U.S. Pat. Nos. to Childress 3,218,967, Schaffert 3,052,213, and Gundlach 3,443,517. In this approach, there is no need to first create a charge-image on the recording medium because the resulting print is shaped by the externally generated electric field which already has a pre-determined pattern for the visible image.

The second approach is the electrophotographic approach as represented by the basic work of Carlson, U.S. Pat. No. 2,297,691 in which an electrophotographic surface is first exposed to a corona electric field to be uniformly charged and thereafter selected areas of this surface are exposed to light to discharge the electric charge in these areas. There are variants of this method in which the discharge is caused by other types of energy than optical. For instance, Gold U.S. Pat. No. 3,206,600 teaches the use of mechanical pressure for effecting the selective discharge.

The third approach is the field induction method in which a pattern of electric charge is formed on a charge-retaining medium by means of an electric field from imaging members having means to control the pattern of the electric field. A visible pattern is subsequently obtained by utilizing the electrostatic force generated from the created charge to attract pigment powder onto the charge pattern. Examples of this approach include Tsukatani et al U.S. Pat. No. 3,354,464, Green et al U.S. Pat. No. 2,953,470, Zaphiropoulos U.S. Pat. No. 3,532,054, Allinger et al U.S. Pat. No. 3,585,061, and Morazadeh and Schaffert: Non-optical Electrostatic Reproduction, IBM Technical Disclosure Bulletin Volume 8 Number 4, September 1965.

These prior art methods have three things in common in their image forming procedure. Firstly, in the case when the charge-image has to be created first, such as the aforementioned second and third approaches, there has been no known way to control the level of charge density. Consequently the resultant image or pattern of images cannot have a controlled level or the controlled levels of desired density.

Secondly, whenever electrical activation is employed, the recording medium has to be positioned between an electrode and a counter-electrode, resulting in several operating limitation in the charge-imaging system, such as the maximum usable thickness of the recording medium and the inaccessibility of the imaging apparatus to those recording media which cannot be physically placed between the electrode and the counter-electrode.

Thirdly, regardless of the many variations of steps devised to achieve the resulting visual record, the applicaton of the electrical image-activation for forming the charge-image takes place in a time all by itself although other forms of activating energy, such as the optical or the mechanical, may be applied prior or subsequent to the application of the electrical image-activating energy. For instance, in the method of Morazadeh and Schaffert, mechanical energy is first applied to selectively change the conductivity of a sheet of paper resulting in a reduction of charge in the areas of high conductivity. In the method of Gold, a pressure pattern is applied to a electrophotographic paper either before or after applying electric charge by corona or by roller. In the method of Zaphiropoulos, mechanical energy is first applied to rupture microcapsules of dielectric material over selected areas of the recording medium and thereafter the recording medium is subjected to electrical charging.

In some cases, non-activating mechanical energy is present during the electrical activation. This is seen, for instance, in Tsukantani et al U.S. Pat. No. 3,354,464 where mechanical force is used to hold multiple sheets of paper in place; in Green et al U.S. Pat. No. 2,953,470 and Allinger et al U.S. Pat. No. 3,585,061 where mechanical force is used to hold the imaging electrode in physical or virtual contact with the recording medium. In these applications, mechanical energy is used only in a supporting role and does not contribute directly to the formation of the charge-image, and it does not bring out any other charge-creating mechanism which the electric activation does not already have.

Employing electrical energy alone for the activation of the charge-image, the majority of the prior art finds that a voltage of 500 volts or higher is necessary. The use of high activating voltage has several drawbacks. First is the reduced flexibility in equipment design and the higher costs of components. For instance, it costs significantly more for transistors having the ability to operate at 500 volts than those to operat at 50 volts. Second is the consideration of print quality. When the activating voltage is high, special attention has to be made to prevent disruptive discharge during the imaging. Otherwise the resulting charge-image may be badly distorted. It is well known that electric breakdown phenomenon depends on such factors as atmospheric pressure, humidity, separation between electrodes, and surface condition of the recording medium, the uniformity of which are difficult to control and there is no sure way to prevent the disruptive discharge at the range of voltages employed by the prior art. Third is the possible hazzard when equipments employing such high voltage are used.

Object of the Invention

In view of the shortcomings and limitations of the prior art as discussed above, it is thus the object of this invention to provide a method and its implementing apparatus for:

Providing a new mode of operation in the field of charge-imaging to remove some of the limitations of the prior art and to make possible new areas of utility, Forming a charge-image or a pattern of charge-images having any one desired level of density chosen from a broad range of possible levels of charge density, Forming a charge-image or a pattern of charge-images having multiple discrete levels of charge density, Forming a charge-image or a pattern of charge-images having a controlled tonal gradation of charge density, Forming a charge-image or a pattern of charge-images with high fidelity to the imaging-surface of the electrode, Forming a charge-image or a pattern of charge-images having one or more of the above four characteristics amenable for electrostatic detection or for subsequent processing for visual or other means of detection, Having the option of applying the electrical image-activation to only one side of the imaging object thereby removing the restriction on the cross-sectional geometry and dimension of the imaging object, Operable at low range of image-activating voltage.

SUMMARY OF THE INVENTION the present invention is based on the fact that an electrical image-activating energy acting together with a mechanical image activating energy produces some synergistic and beneficial results to bring out other image-forming mechanisms which would not be available if the imaging process is performed with electrical energy alone or with the mechanical energy alone. By co-activating the charge-image with both electrical and mechanical energies in such a way that there is a period of time when both act on a charge-retaining object, I found that I can control the charge density on the consequent charge-image to be at any one level of charge density within a wide range of charge density from light to heavy.

As consequence of this basic fact, I can go one step further to obtain different levels of charge density for the consequent charge-image by setting at least one of the two image-activating energies at different magnitudes, or by varying the length of the co-activating time period of the two energies.

I can further produce a charge-image with a very low electrical image-activating voltage as a trade-off with the consequent density.

I also found that the charge-image thus formed is of high fidelity to the original on the controlling electrode.

Besides the ability to control the charge density, I also found that the simultaneous application of electrical and mechanical image-activating energies enables me to place the electrical-activation electrode and counter-electrode on the same side of the imaging object as well as the conventional way of placing the electrode and counter-electrode on opposite sides of the imaging object.

Review of the prior art shows that there is nothing in recognition or in foreshadowing what I have discovered. Hereby I term this charge-imaging process the "mechano-electrostatic charge-imaging" to distinguish it from the prior-art techniques, and designate the range of magnitude of the mechanical charge-imaging energy and the range of magnitude of the electrical charge-imaging energy which, when co-acting together, can control the density of the consequent charge-image, as the "mechano-electrostatic range" of the charge-imaging energies. When a charge-imaging system is operating with co-activating electrical and mechanical energies in their respective mechano-electrostatic range, the system is referred to as being operated in its "mechano-electrostatic imaging domain". A charge-imaging system as referred to herein comprises the imaging apparatus, the charge-retaining recording medium, the power source, and optional components as needed, such as the pigmenting powder if the charge-image is to be rendered visible.

Aside from its basic principle of simultaneous activation with electrical and mechanical energies as described above, there are other feature differences between the mechano-electrostatic imaging method and each of the prior-art methods.

In the aforementioned first category of prior art methods, i.e. the material transfer approach as practiced by Gundlach and others, the recording medium is not required to have the charge-retaining property although it should be able to hold the pigmenting particles which come to its surface. It is also not required to create a charge image on the recording medium. The resulting image is formed by having pigment powders transferred and guided by a shaped electrostatic field between a pair of electrodes and having the recording medium to intercept and hold the transferred pigments. The present invention requires a recording medium which has a charge retaining property and onto this recording medium a charge image must first be formed. It is the electrostatic force from the charge in the image that attracts and holds the pigment powder which is applied to the surface of the recording medium subsequent to the charge imaging process after the image is formed and after the electrodes have been disconnected from the electrical energy.

In the second category of the prior art methods, i.e. the electrophotographic approach by Carlson and others, the electrical charging or discharging is applied in a non-selective manner to the whole surface of the recording medium with corona discharge or electrified roller. In contrast, the present invention employs selective local charging onto only a pre-determined portion of the recording medium with galvanic electricity confined in conductive wires.

In the third category of the prior-art methods, i.e. the field-induction approach as employed by Green and others, it creates electric charge on the recording medium by electrostatic induction from a strong electric field generated by the relatively high voltage between a pair of electrodes as intercepted by the recording medium. Since the electric field has the ability to permeate through space, a strong field in a magnitude as used in the prior art does not necessarily require that the electrodes be in physical contact with the recording medium in order to create charge on that medium. Consequently the geometry of the charge image thus created may not exactly follow the predetermined nature of the electrodes, resulting in infidelity and deteriation. This fact will be illustrated in connection with FIG. 9. It is also found that at a high field-intensity, such as employed in the prior art, the images thus created all have very high density, and there is no known method to control or to reduce the charge density to noticeable lower levels. On the other hand, by virtue of the co-acting mechanical activation, the mechano-electrostatic imaging process brings out other image-forming mechanisms which otherwise would not come into effect and is capable of creating images having a wide range of charge density. These other imaging mechanisms resulting from the synergistic co-action of the electrical energy and the mechanical energy may include the following and others not yet identified, 1. Micro-conduction of electrons which occurs in the recording medium as a result of a change in the Fermi electron energy in the presence of mechanical stress from the co-acting mechanical energy. Portion of these electrons are trapped at the surface of the recording medium, constituting part of the created charge. Further discussion will be given in connection with FIG. 6A.

2. Parametric charge-pumping due to a change in capacitance introduced between the surfaces of the imaging members upon the application of the mechanical image-activating energy in the form of impact or pressure. Details of this charging mechanism will be duscussed in connection with FIG. 6B.

One common feature of these charge-imaging mechanisms is that the existence of these mechanisms depends on both the electrical activation and the mechanical activation and they would not exist if one of the activations is missing or not occurring in a common period of time with the other. For instance: as will be discussed fully in connection with FIG. 6B, without the presence of the mechanical energy to deform the recording medium and to vary the capacitance between the electrodes during the electrical activation, there would be no charge-pumping effect to create the charge; on the other hand, without the presence of the elelctrical activation, the application of mechanical energy alone would not result in the charge-pumping effect.

Another common feature of these charge-imaging mechanisms is that the density of the charge thus created is related to the magnitude of the electrical activating energy and the magnitude of the mechanical activating energy. Details of this feature will be given in connection with FIGS. 7 and 8.

A further feature of these charge-imaging mechanism is that they create electric charge only on locations where both the electrical activation and the mechanical activation are in effect. Consequently the resulting charge image can have a higher fidelity than the prior art field-induction method.

The aggregate of these synergistic effects of the mechano-electrostatic imaging enables the present invention to provide results not obtainable from the prior art, i.e., the controllability of charge density and as a result easier control of shade and degree of darkness of the visible print; the ability to make a plurality of images each having similar or different levels of charge density and as a result, visible print having a tonal gradation can be made; and the ability to operate with an electrical imaging-activating energy at a range of voltage remarkably lower that that employed in all the prior art.

BRIEF DESCRIPTION OF DRAWINGS

Reference is now made to the accompanying drawings wherein like reference numerals designate like parts and wherein.

DETAIL DESCRIPTION OF THE DRAWINGS

Figure 4:
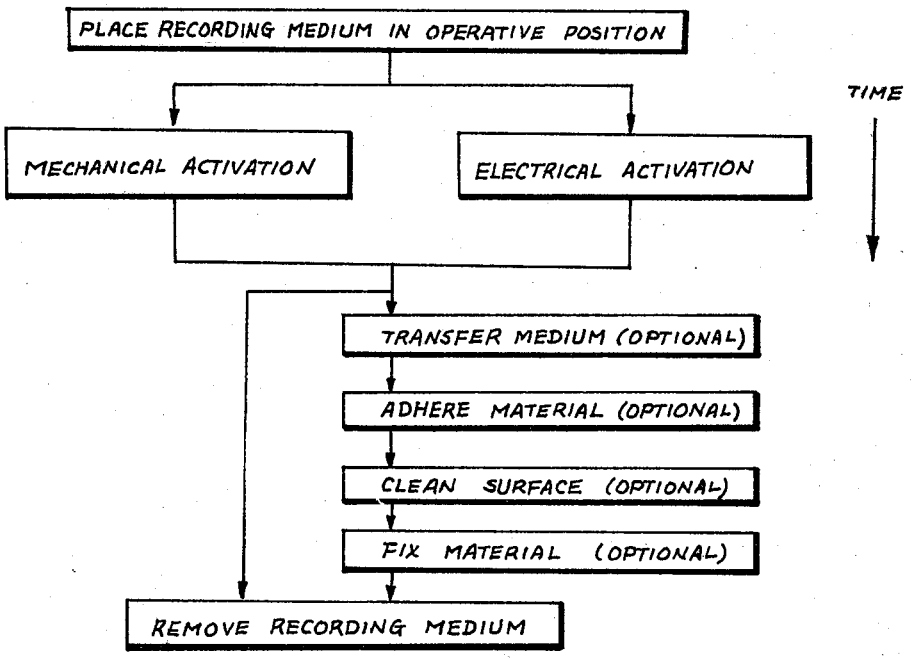
FIG. 4 is a block diagram showing an embodiment of the method of the present invention.

Attention is first directed to FIG. 4, therein disclosed is a preferred embodiment of the method of the present invention. It comprises the steps of first placing a charge-retaining recording medium in operative relationship with a charge-imaging means. Subsequently an electrical charge-image activating energy of a proper pre-set magnitude within the mechano-electrostatic imaging range and a mechanical charge image-activating energy of a proper pre-set magnitude within the mechano-electrostatic imaging range are applied to the charge-retaining recording medium via the charge-imaging means. It is required that there is a period of time during which both the electrical and the mechanical image-activating energies are actively engaged in the activation, although it may not be necessary that they are initiated or terminated at the same time. It is desirable that the electrical linkage be opened at the end of the electrical activation at one location of the recording medium, otherwise the created charge may fade away in some cases.

Figure 7:
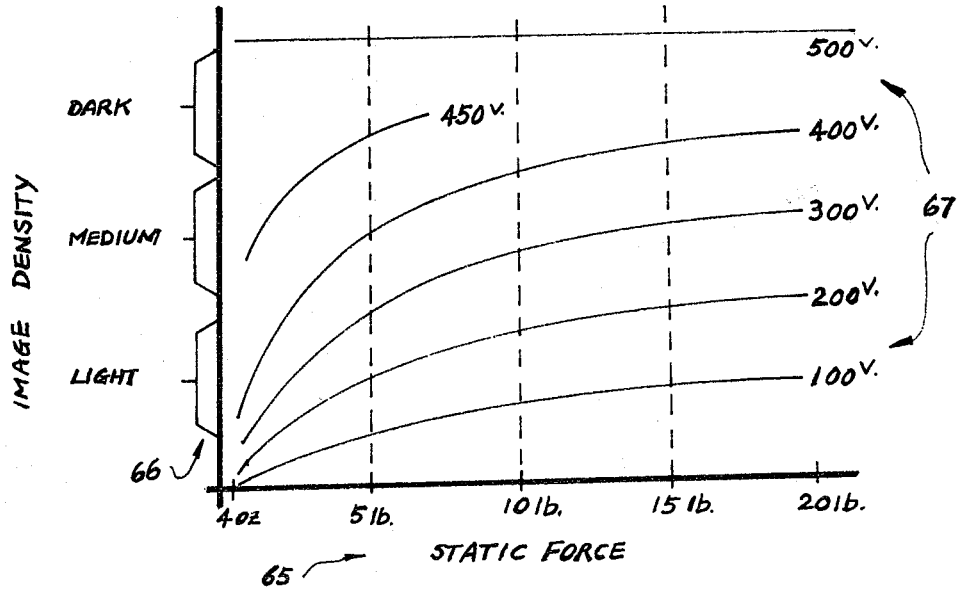
FIGS. 7 and 8 are graphic representations of typical experimental results showing the inter-relationship among the magnitudes of the electrical and the mechanical activations and the consequent charge density of the formed images.
Figure 8:
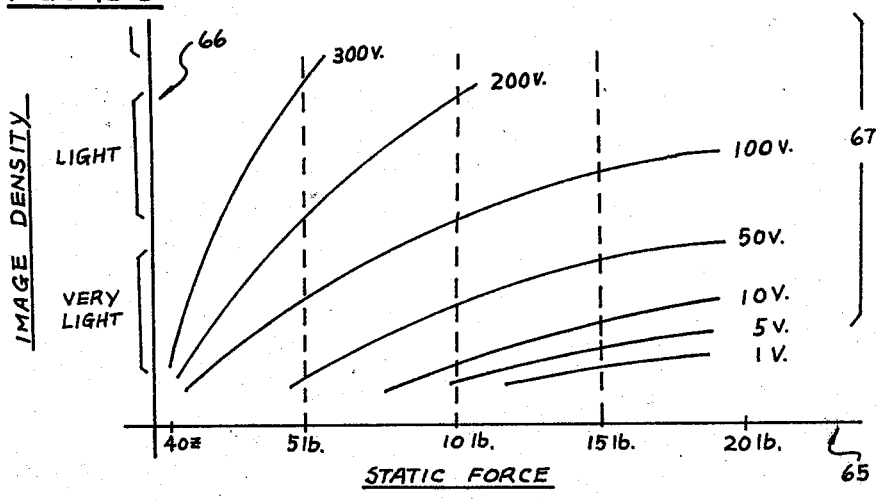

To be precise, the proper magnitudes of the two image-activating energies are to be determined with the help from an empirically established three-way relationship among the two image-activating energies and the charge density of the consequent image. An illustrative set of such a relationship is shown in FIGS. 7 and 8 to be described later. In practice it may not be necessary to first formally establish such a set of three-way relationship. For instance, the required magnitudes of the two activating energies may be found by trial and error.

After the charge-image is formed, the charge-retaining medium and the imaging means are separated from each other and the image is ready for electrostatic detection. In case the image is to be detected by visual or other means, the image is subjected to further processing for that purpose, such as the optional steps indicated in FIG. 4, i.e. the adhering of material to render the charge image detectable by that particular method, the cleaning of the surface of the medium, and the fixing of the adhered material so that the image may become permanent.

Figure 5:
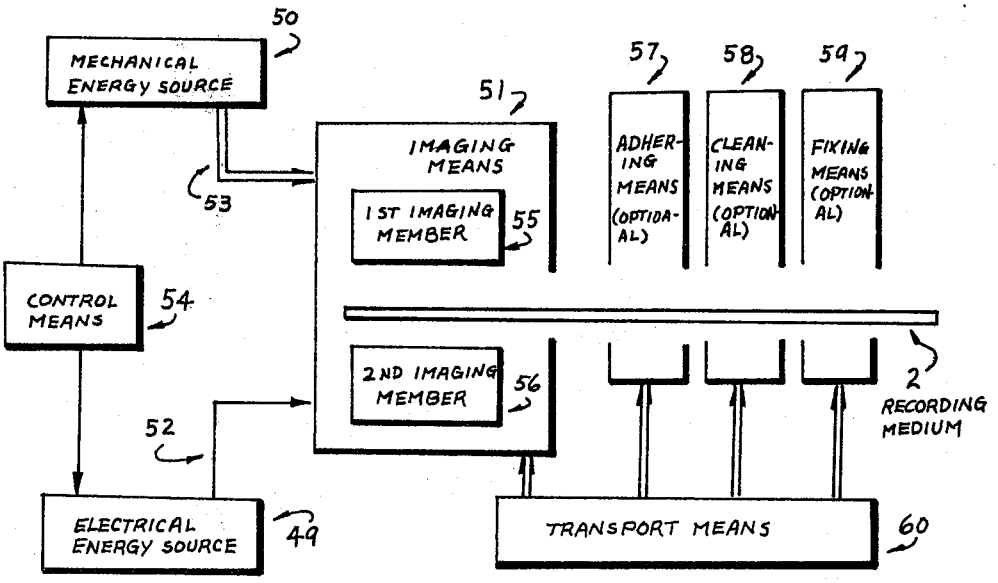
FIG. 5 is a block-schematic diagram of a preferred functional embodiment of the present invention FIGS. 6A and 6B pertains to the possible explanation of the new imaging mechanism involved in the present invention .

FIG. 5 is a preferred functional embodiment of the present invention in a charge-imaging system. The electrical activation function 49 supplies the electrical image-activating energy of a pre-set magnitude or of a range of presettable magnitude at least part of which lies in the machano-electrostatic imaging domain of the charge-imaging system is use. The mechanical activation function 50 supplies the mechanical image-activating energy of a pre-set magnitude or of a range of presettable magnitude at least part of which lies in the mechano-electrostatic imaging domain of the charge-imaging system in use. The imaging function 51 performs the activation of the charge-image to the recording medium 2. It in turn comprises a first imaging sub-function 55 and a second imaging sub-function 56 for transmitting and modulating the electrical and the mechanical image-activation to the medium 2. Electrical linkage function 52 conducts the electrical image-activating energy function 49 to the imaging function 51. Means 53 connects the mechanical activation function 50 to the imaging function 51. Timing control function 54 controls and synchronizes the application of the elelctrical charge-image activating energy and the mechanical charge-image activating energy in a manner as described for operating the charge-imaging system in the mechano-electrostatic charge-imaging domain. At least one of the two imaging functions 55 and 56 comprises modulating means to modulate the geometry of the resulting image. An example of such a modulating means comprises extruded contours having a geometry of a predetermined nature on a surface of the imaging member and the said surface is used for transmitting the mechano-electrostatic activation to the charge-retaining medium 2. The mechanical image-activation may be effected by positional displacement of one or both the imaging functions 55 and 56 against the charge-retaining medium 2 from an impacting force or from pressuring.

Optional functional means which can be incorporated into the embodiment for obtaining a visible print include the adhering means 57 for adhering visible pigments to the charge image; the cleaning means 58 for cleaning the surface of the recording medium; the fixing means 59 for making the pigments permanently adhered to the recording medium, and the transport means 60 for moving the recording medium. The implementation of processing with visible pigments is known to the art. Other appropriate types of material may be used for adhering to the image when other methods of detection are contemplated. For instance, ferromagnetic powders may be used to adhere to the charge-image for the purpose of magnetic detection.

The charge-retaining recording medium 2 comprises material capable of retaining the electric charge. Plastic coated paper similar to those used in the electrostatic non-impact printer such as the Versatec printer may be used.

Figure 1A:
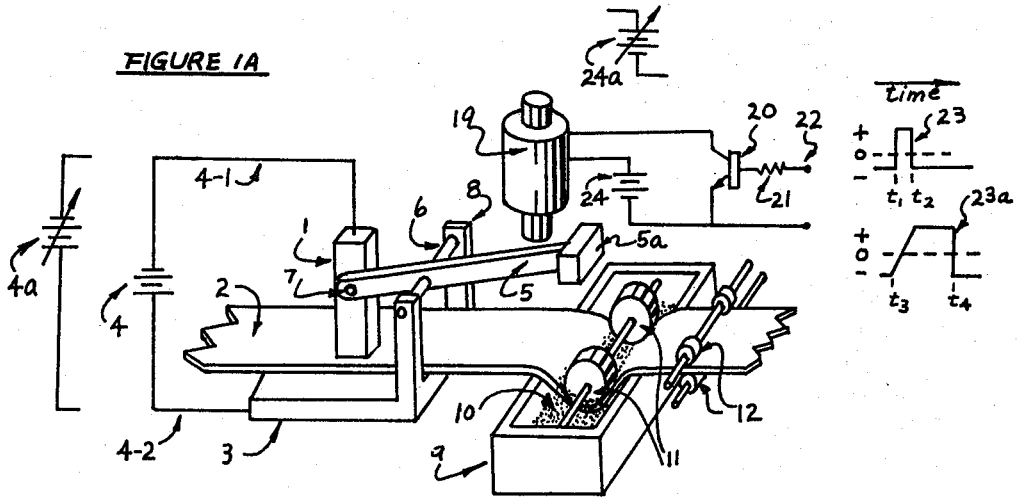
FIG. 1A is a semi-schematic drawing of one physical arrangement implementing the preferred functional embodiment of FIG. 5.

Although each of the functional components as shown in the functional embodiments are regarded as a separate entity in terms of the function it performs, yet in the physical implementation some of the elements may serve more than one function. For example, the mechanism for effecting the control of the mechanical activation may also serve to control the electrical activation, as illustrated in the embodiment of FIG. 1A, in which the electromagnet 19 together with the mechanical linkage of lever 5, joint 7, and rod 6, serve on the one hand as mechanical activation by imparting impacting force to the recording medium 2 through the electrode 1. However, this same group of physical elements also serve to conduct the electrical activation by moving the electrode 1 in or out of contact with the recording medium 2 to cause the make or break of the electrical activation.

Figure 1B:
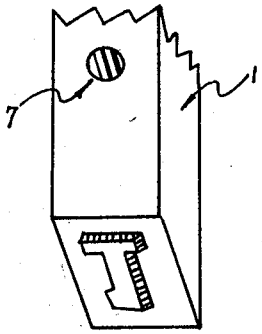
FIGS. 1B and 1C are perspective views of two illustrative arrangements of the imaging member of the preferred functional embodiment of FIG. 5.
Figure 1C:
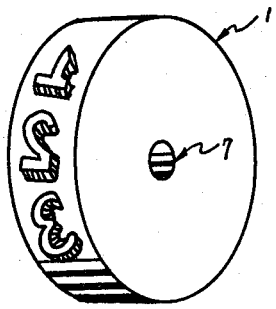
Figure 1D:
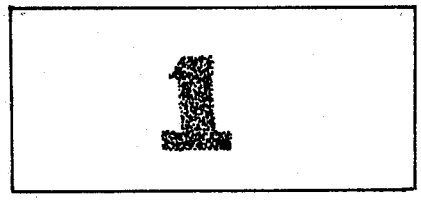
FIG. 1D depicts a charge-image which has been pigmented for visual detection.

FIG. 1A shows one of the many possible physical implementation of the preferred functional embodiment of FIG. 5. The electrical activation source function 49 is performed by the battery 4 which has a pre-set voltage within the mechano-electrostatic imaging range of the imaging system. The mechanical activation source function 50 in this implementation physically comprises an electro-mechanical converter 19 and its energizing source 24. The electro-mechanical converter 19 may be an electromagnet as shown, or a solenoid actuator which is not shown and is a well known component. The voltage and power capacity of the battery 24 are such as to cause the converter 19 to generate a mechanical activating energy requisite to the mechano-electrostatic imaging requirement as will be discussed in conjunction with FIGS. 7 and 8. The imaging function physically comprises the electrode 1 as the first imaging member, and the counter-electrode 3 as the second imaging member. Electrode 1 has an imaging surface with protruded contour of a predetermined nature, as examplified in FIG. 1B, for activating and modulating the geometric configuration of the charge image. Another form of imaging surface which has a set of selectable configuration is shown in FIG. 1C. A resulting visible image is shown in FIG. 1D. The electrical linkage function 52 physically comprises the conducting wire 4-1 which connects one polarity of the battery 4 to the electrode 1, and the conducting wire 4-2 which connects the other polarity of the battery 4 to the counter-electrode 3. The mechanical linkage function 53 physically comprises the lever 5, joint 7, rod 6 and support 8. Lever 5 comprises ferromagnetic material. The control function 54 physically comprises the transistor 20, resistor 21, and means **5*a*** for keeping electrode 1 seperated from the recording medium 2 when activation is not present. The separate means 5*a* in FIG. 1A is shown as a counter-weight. Other elements, such as a return spring, can be used for the same purpose. To generate mechanical activating energy in the form of impact, a control signal having a waveform typical to that shown in 23 is applied to the input point 22. At the time $t_1$, the control signal 23 turns positive and causes the npn transistor 20 to conduct, resulting in the energization of the actuator 19 which in turn pulls the right-hand side of the lever 5 upward to cause a down stroke of the imaging electrode 1 to impart an impacting energy to the recording medium via the modulating surface of the electrode 1. At the time $t_2$, the control signal 23 becomes negative and causes the transistor 20 to open, resulting in the de-energizing of actuator 19 and allowing the counter-weight 5*a* to open up the electrode 1 from the recording medium 2, disabling both the mechanical activation and the electrical activation at the same time. To generate mechanical energy in the form of pressure, a control signal having a waveform typical of 23*a* is used. The slope of 23*a* at $t_3$ enables the actuator 19 to be energized gently to effect the imaging electrode 1 to act on the recording medium 2 with pressure and no impact. If needed, the co-activating time period between $t_1$ and $t_2$, or that between $t_3$ and $t_4$, may be varied to control the charge density of the consequent charge image.

During the time of mechanical activation either by impact or by pressure, the dielectric circuit path comprising battery 4, linkage 4-2, counter-electrode 3, recording medium 2, electrode 1, and linkage 4-1 is connected and complete, enabling the electrical energy to act, at the same time with the mechanical activation, on the recording medium 2, thus effecting the mechano-electrostatic charge-imaging. When it is desired to have the charge pattern with different levels of charge density, the batteries 4 and 24 may be substituted by the variable-voltage power supplies 4*a* and 24*a* respectively so that the magnitudes of the electrical and mechanical activations can be properly varied within the mechano-electrostatic imaging range for different levels of desired charge density. Instead of using variable-voltage power supply, a variable resistor in series with a fixed-voltage supply may be used for this purpose.

The recording medium 2 bearing the charge pattern may be moved optionally, if needed, to a material adhering unit 9 containing powders 10 which are attracted to the charged areas of the medium 2 by the electrostatic force generated from the charges in these areas. The rollers 11 serve to dip the recording medium into the powders 10. Rollers 12 serve to transport the recording medium 2 by friction. Rollers 12 are driven by a prime mover which is not shown in drawing 1A.

Figure 2:
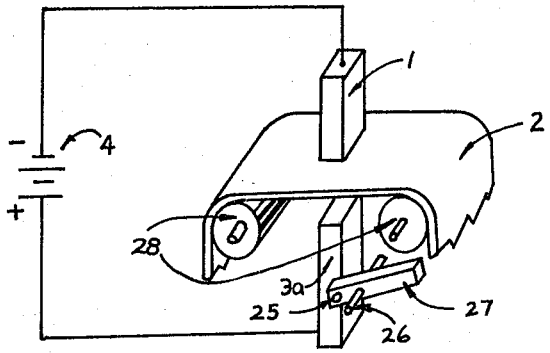
FIG. 2 is a semi-schematic drawing of another physical arrangement implementing the preferred functional embodiment of FIG. 5.

FIG. 2 shows another physical implementation of the imaging means function 51, in which the mechanical activation is transmitted to the recording medium 2 via a second imaging member, counter-electrode 3*a*. The mechanical image activation can also be transmitted via both imaging members if needed. Lever 27, rod 26, and joint 27 are mechanical linkage elements which are the counterpart to the elements lever 5, rod 6, and joint 7 respectively in FIG. 1A.

Figure 3C:
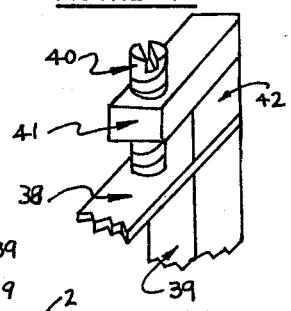
FIG. 3C examplifies an arrangement wherein the mechanical image-activation can be varied at different magnitudes.
Figure 3A:
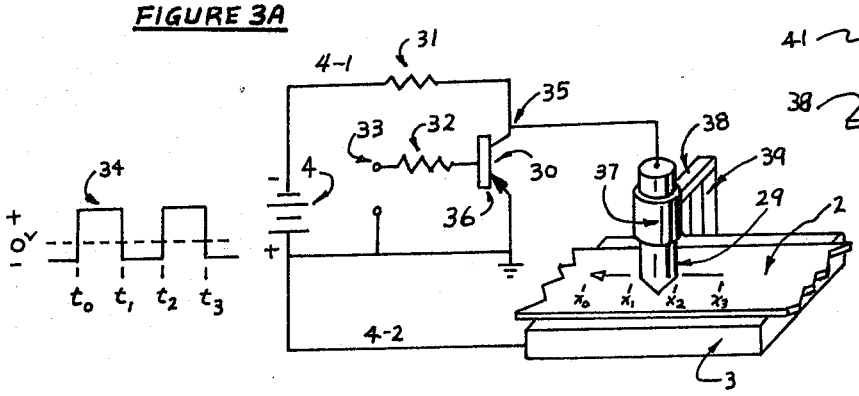
FIG. 3A is a semi-schematic drawing of a physical arrangement employing a continuous mechanical image-activation, for implementing the preferred functional embodiment of FIG. 5.

FIG. 3A shows another physical arrangement of the preferred functional embodiment of FIG. 5. In this implementation, the electrical energy source 49 is performed by the battery 4 meeting the same requirements as that discussed in connection with FIG. 1A. The mechanical energy source means 50 now comprises a pressure generating member, one form of which is shown as the compressive element 38 which is properly pretreated for this purpose. Spring steel is a material suitable for this element. One end of the pressure-generating member 38 is fastened to the linkage and support 39 and the other end exerts a pressure onto the charge-retaining medium 2 via the imaging members 29 and 3 through the mechanical linkage members 37 and 39. The pressure-generating member 38 has a pre-set magnitude within the mechano-electrostatic imaging range and appropriate for achieving the desired level of charge density when co-activating with the electrical imaging energy from the source 4. The magnitude of the mechanical imaging energy may be varied by the assembly comprising an adjusting screw 40, a screw-holding piece 41, and a spacer-piece 42. The screw-holding piece has a threaded hole to hold the screw. When the screw is turned in one direction, it will move upward to decrease the image-activating pressure. When the screw is turned in the other direction, it will move downward to increase the image-activating pressure.

The means for imaging function 51 physically comprises a first imaging member electrode 29 and second imaging member counter-electrode 3. The activating surface of the electrode 29 takes the geometry of having a small area in comparision to the size of the over-all image and having a circular or rectangular contour. Other contours including oval, square, polygonal, or even irregular, can be used. The geometry of the resulting charge image is modulated by the relative motion between the recording medium 2 and electrode 29, together with the presence or absence of the electrical image activation.

Figure 3B:
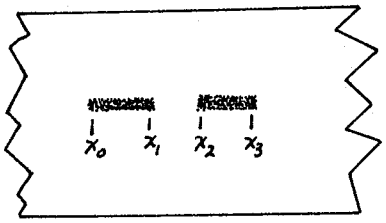
FIG. 3B is an example of result from arrangement in FIG. 3A.

The control means 54 comprises transistor 30 and resistor 31. Control signal having waveform typical as that shown in 34 is present at the input terminal 33. The charge activation can best be described in conjunction with FIG. 3B. The recording medium 2 has a translational displacement as indicated by the arrows in both FIGS. 3A and 3B. At the time moments $t_0$, $t_1$, $t_2$ and $t_3$, the recording medium passes the imaging tip of the electrode 29 at $x_0$, $x_1$, $x_2$, and $x_3$ respectively. During the time periods before $t_0$, between $t_1$ and $t_2$, and after $t_3$, the control signal is at negative potential with respect to that of the emitter of the pnp transistor 30, causing the latter to conduct current. The voltage drop across the load resistor 31 is such that the collector 35 of the transistor is down to practically ground potential. Since collector 35 of the transistor 30 is connected to the imaging electrode 29, the latter is also at ground potential and thus the electrical activation is absent. During the periods $t_0$ to $t_1$, and $t_2$ to $t_3$, the control signal 34 is at a positive voltage, causing the pnp transistor 30 to open, allowing the voltage from battery 4 to appear across the electrode 29 and the counter-electrode 3 and to serve as electrical activation. Since the mechanical activating energy in the form of pressure is constantly in action in this arrangement, the presence of the electrical activation will fulfil the requirements of mechano-electrostatic charge imaging, resulting in the loci of electric charge from this activation from $x_0$ to $x_1$ and from $x_2$ to $x_3$, having a charge density predetermined by the voltage of battery 4 and the pressure from the generating member 38. After pigmenting for visibility, the resulting print may take the form as shown in FIG. 3B. The recording medium 2 may be caused to have a 2-dimensional movement and results in a 2-dimensional visible print.

In this implementation, the voltage of the source 4 and the value of the series resistor 31 combinedly serve to set the magnitude of the electrical charge-image activating energy for the desired level of charge density of the consequent image when coactivating with the mechanical activating energy provided by the pressure generating means described earlier. The magnitude of the electrical activating energy thus provided may be varied by using a different value for resistor 31 or by a source with different voltage. A variable resistor may be used in place of the fixed resistor 31 so as to achieve fine adjustment of the electrical activation. A further option of refinement is to make a programmed control of the voltage from source 4 or of the series resistance to control in turn the consequent charge density in accordance with a pre-arranged program.

Figure 6A:
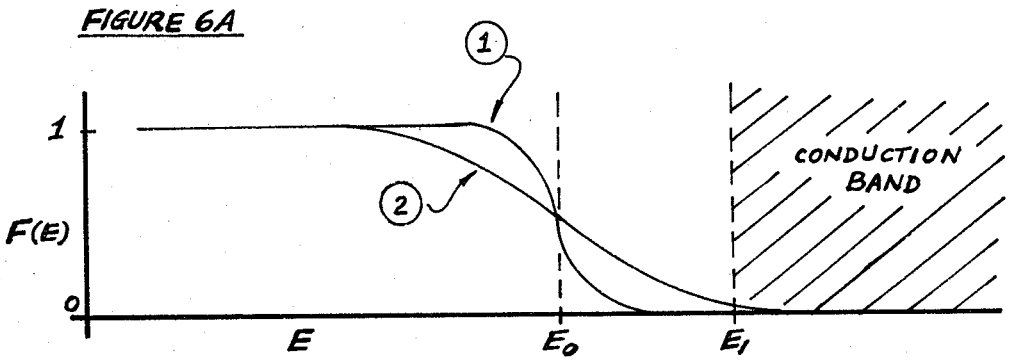

FIG. 6A pertains to the explanation of one of the synergistic charge imaging mechanism as a result of the mechano-electrostatic charge imaging principle of the present invention. F(E) represents the Fermi Factor which depicts the probability that a quantum state of energy level E is occupied by electrons in a solid material. $E_0$ is the Fermi level as defined in quantum electronics and is a characterization of the solid material used. $E_1$ is a lower limit of the conduction band and is also a characterization of the material used. Curve 1 depicts the energy probability distribution at normal temperature. Under this condition, there is no electron in the material having energy above $E_1$ and the material behaves as an insulator. It is well known that at elevated temperature the energy probability distribution curve stretches out and F(E) may have a small portion extended beyond $E_1$, as represented by the curve 2 in this figure. As a result, there exists a small number of electrons in the unfilled conduction band of the material which enables this normally insulating material to conduct very slightly upon the application of an electromotive force. It is possible that the mechanical energy absorbed by the recording medium 2 could also cause similar effect to cause a micro-conduction of current or the migration of electrons. Some of these electrons could be trapped at the boundary and becomes the created charge. Since a higher magnitude of mechanical activating energy could have the equivalent effect of a higher temperature on the probability curve and causes a higher microconduction to result in higher charge density in the created image and since a higher activating voltage would do the same, it justifies the empirical result that the created charge has a density proportional to the mechanical activating energy and to the electrical activating energy.

Figure 6B:
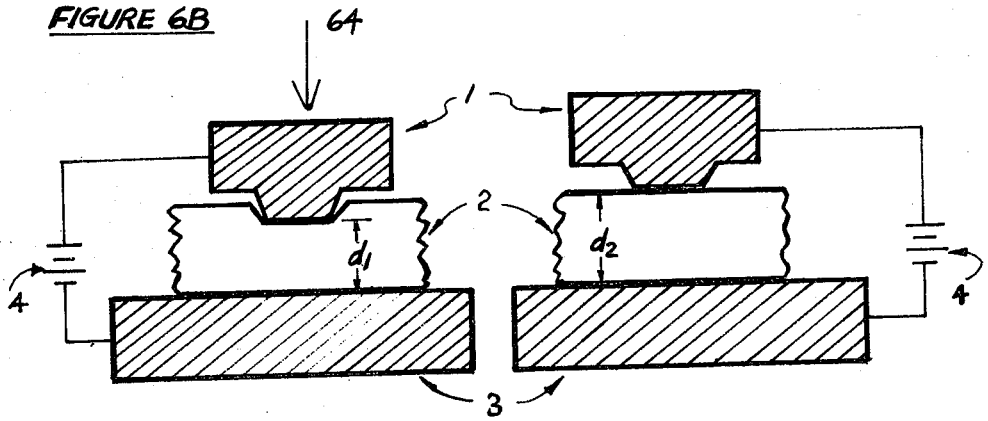

FIG. 6B pertains to the explanation of another one of such synergistic charge imaging mechanism as a result of the mechano-electrostatic charge imaging principle of the present invention. The drawing at left shows that during mechanical activation, the recording medium is compressed, by mechanical force 64, between the imaging electrodes 1 and 3, resulting in reduced separation $d_1$ between the surface boundaries. At the removal of the mechanical activation, the separation between the surface boundaries increases to $d_2$. From the basic facts in electricity that the faradic charge stored in a dielectric (in our case the recording medium 2) is proportional to the capacitance, and that the capacitance is inversely proportional to the separation (in our case $d_1$ and $d_2$), it is easy to understand that during activation, the recording medium can store more faradic induction than it can hold after the removal of the mechanical activation. The excess of the electric induction results in surface charges at the discontinuity, namely the surface, of the recording medium as is required by Farady's law of induction. This surface charge contributes to the charge in the image.

The above description can be stated more concisely and precisely in algebraic terms, i.e.

| | | |
|---|---|---|
| capacitance between surfaces: | | where: |
| during activation, | $C_1 = k/d_1$ | k = proportional |
| after activation, | $C_2 = k/d_2$ | constant |
| Induction at activation, | $Q_1 = C_1V$ | V = activating |
| | $= (k/d_1)V$ | voltage |
| Amount of charge the recording medium can store after activation, | $Q_2 = C_2V$ | |
| | $= (k/d_2)V$ | |
| Since $d_2$ is larger than $d_1$, Hence $Q_2$ is smaller than $Q_1$ | | |
| The difference: | $q = Q_1 - Q_2$ | |
| | $= kV(1/d_1 - 1/d_2)$ | |

q is trapped at the surface and becomes the created charge to contribute to the charge image.

Due to the fact that stronger mechanical activation will cause a smaller separation $d_1$ resulting in a larger value of q, it can be seen that charge created by such a parametric charge-pumping mechanism is proportional to the magnitude of the mechanical activation applied. This is in harmony with the experimental empirical result as discussed in conjunction with FIGS. 7 and 8. Also, the above quantitative relation also verifies the proportionality between the created charge q and the electrical activation V.

FIG. 7 summarizes in graphic form a set of representative experimental result showing the inter-relationship among the magnitude of the electrical image-activating energy, the magnitude of the mechanical image-activating energy, and the density of the created charge. The arrangement used is similar to that of FIG. 1A having an imaging surface approximately that of an upper-case letter of a standard typewriter. The recording medium comprises a plastic coated paper similar to those used in the commercial electrostatic printers such as the Versatec matrix printer. The pigmenting material employed is similar to the type used in electrostatic copying machines such as the Xerox type. The horizontal coordinate 65 represents the magnitude of the mechanical image-activation in terms of pressure. The vertical coordinate 66 represents the relative density of the charge in the created image as judged from the shade of the print after black pigmenting particles have been adhered to the charge-image. The group of curves 67 depicts the three-way inter-relationship among the electrical image-activation, the mechanical image-activation, and the resulting charge density in the created image.

FIG. 8 is similar to FIG. 7 but has an expanded vertical coordinate 66 to show the inter-relationship at low activating voltages. It should be pointed out that the charge density as classified in FIGS. 7 and 8 under the categories of dark, medium, light, and very light, is judged by first pigmenting the charge image and then comparing the relative shade visually. It is obvious that pigments of a deeper color will shift this scale upward, while pigments of a lighter color will shift this scale downward. Furthermore, the length of the image activating period also effects the charge density and hence the shade of the visible rendition. FIGS. 7 and 8 are prepared under the constant activation-period basis of one tenth of a second.

Although the set of relationship as shown in FIGS. 7 and 8 is based on a particular design of equipment in conjunction with certain types of components and materials, generalizations can be made to apply to other cases in general, i.e.

1. There exists a certain boundary for the magnitude of the electrical image-activating energy in its mechano-electrostatic imaging range, as examplified and somewhat over-simplified by the 500 volt line in FIG. 7 for the particular system discussed. Above such a boundary, it appears that the charge-image is formed predominantly by the effect of the faradic field induction which is characterized by the space-permeating effect to be described in connection with FIG. 9, and by the resulting of the very high and saturating charge density which can be modified little by either varying the magnitude of the activating voltage or the length of the activating time period. Thus no functional relationship can be established between the consequent charge density and the image-activating energy, either electrical energy alone or electrical energy co-acting with mechanical energy. Nor functional relationship can be established between the charge density and the length of the activating period.

2. This "boundary" in terms of voltage is in the order of 500 volts for a medium having the thickness of a regular writing paper as summarized from publications and patents of the prior art and as found from experiment from which FIGS. 7 and 8 are based. In closer look, this boundary may vary somewhat depending on the design of the equipment in terms of the size and shape of the imaging surfact of the imaging electrode, the material of the imaging electrode, the thickness and composition of the recording medium, the type of the adhering material, the polarity of the activating voltage, the length of the image-activating period, the form of the mechanical activation, and on environmental factors such as humidity and atmospheric pressure. Taking into account of all the possible fluctuations of this boundary value, it would be more accurate to describe the boundary as a zone comprising all the possible fluctuations rather than a line comprising only one definite level of voltage.

3. Below the above defined boundary zone, functional dependence exists among the density of the consequent charge-image and the non-zero magnitudes of the electrical and mechanical image-activating energies, i.e.

(a) By pre-setting the electrical activation and the mechanical activation at respective known magnitude, it is possible to predict the level of charge density of the consequent charge-image prior to the activation of that image. This pre-setting can be done at any time ranging from the time when the imaging apparatus is designed or manufactured to the very instant when the the image activation begins for the consequent charge-image or the consequent part of the charge-image.

(b) By holding the pre-set magnitude of one of the two activating energies constant and varying the pre-set magnitude of the other, the charge density of the consequent image varies in proportion to the latter magnitude.

(c) For a given level of desired charge density, it is possible to find all the possible combinations of magnitudes in the electrical and the mechanical activating energies for forming a charge-image having such a level of charge density.

4. Below this boundary zone, functional dependence also exists between the charge density of the consequent charge-image and the length of the image activation period while keeping the magnitudes of the activating energies constant.

The above generalization provides us with philosophical enlightment as well as practical utility. The points are:

(1) We may now come to realize that we do not have to use an electrical activation having a range from at least several hundred volts to thousands of volts, as practiced in the prior art, to form charge-image.

(2) We can form charge-image with an electrical activation within the mechano-electrostatic imaging range which is no higher than the boundary zone of that particular charge-imaging system in use.

(3) We can control the charge density of consequent charge-image for one or more of the following:

(a) Having a uniform desired level of charge density by presetting the image-activating energies at respective proper magnitude either at the design of the equipment or prior to the image activation.

(b) Having multiple levels of desired charge density by presetting the magnitude of one or both the image-activating energies at multiple discrete levels.

(c) Having a desired continuously varied gradation of charge density by continuously presetting the magnitude of one or both the activating energies at various values.

(d) Trading off the charge density for a lower magnitude in the electrical activating energy.

(e) Trading off the imaging speed for a lower magnitude in the electrical activating energy.

(f) Trading off imaging speed for a higher charge density.

The above utility aspects have neither been practiced nor forshadowed in the prior arts and constitute some of the unique features of the mechano-electrostatic charge-imaging process of the present invention. The use of the inter-relational curves as shown in FIGS. 7 and 8 is almost self-evident. The following examples are provided for further illumination.

EXAMPLE 1

In order to use low cost transistors which can only be operated below 50 volts, FIG. 8 shows that a co-acting force of 10 to 15 pounds per letter with a 50 volts electrical activation, we should be able to get a charge image having a charge density in the upper "very light" range.

EXAMPLE 2

If it is desired to have a charge density in the middle of the medium level, FIG. 7 shows that two of the many sets of possible values we can take are 400 volts at 5 pounds per letter or 300 volts at 15 pounds per letter.

EXAMPLE 3

If it is desired to have three levels of charge densities in a charge pattern at medium, light, and very light, from FIGS. 7 and 8, one of the many possible choices would be 400 volts, 200 volts, and 50 volts, at 10 pounds per letter.

In the above discussions, the mechanical energy has been in terms of pressure. Similar inter-relationship as shown in FIGS. 7 and 8 can also be established in terms of electrical voltage and mechanical impact force. By the same token, the electrical activation can also be in terms of current instead of voltage. The mechano-electrostatic imaging principle would still be valid with these variations in parameters.

Figure 9:
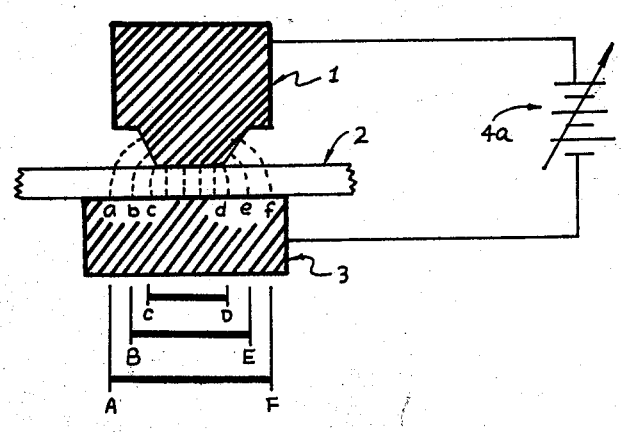
FIGURE 9 PRIOR ART
FIG. 9 pertains to the description of a characteristic of a prior-art technique.

FIG. 9 is a cross-sectional view of a recording medium 2 in operational position with the electrodes 1 and 3. The dotted lines designated as a,b,c, . . . d,e,f, represent electrostatic field lines. When the electrical activation provided by the variable supply 4*a* is at a lower voltage, only the field lines c . . . d have the strength to cause electric charge on the medium 2, result-in a charged pattern CD. As the activating voltage increases, the lines b and e also have strength to induce charge, resulting in a longer image BE. As the voltage further increased, similarly the image lengthens to AF. This demonstrates one basic aspect of the field induction principle in the prior art, i.e. the electric field can permeate the space and create electric charge on the recording medium 2 with or without the physical contact of the imaging surface to the recording medium.

Figure 10:
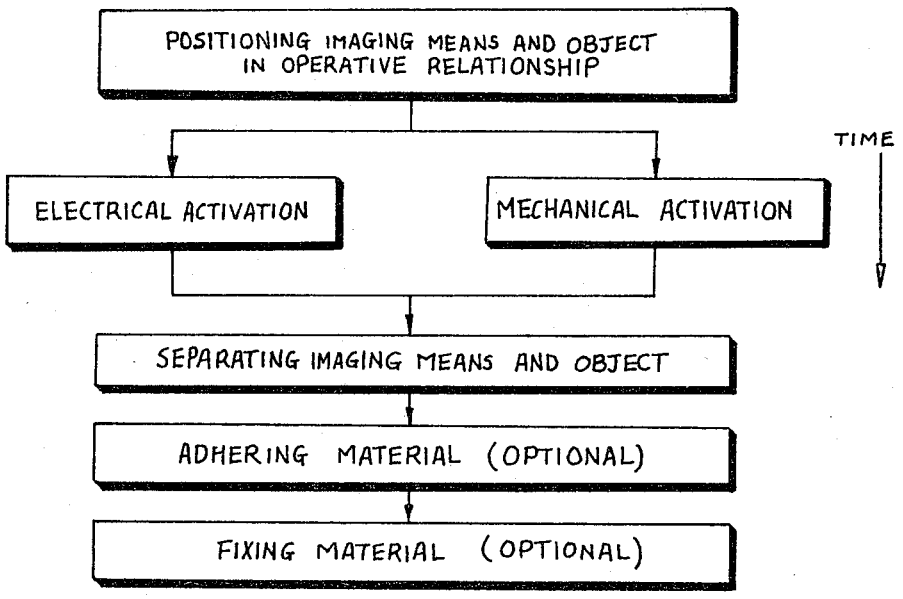
FIG. 10 is a block diagram showing another embodiment of the method of the present invention.

FIG. 10 is a block diagram showing another preferred embodiment of the method of the present invention. It comprises the steps of first positioning a charge-retaining imaging object and the imaging means in operative relationship by either bringing the imaging object to the imaging means or bringing the imaging means to the imaging object. The imaging object may be of any shape and dimension compatible with the design of the imaging means so that a operative relationship can be arranged for image-activation. For example, it may be in sheet form to serve as a recording medium, or it may be a container which needs imaging for identification. Subsequently electrical and mechanical image-activating energies are applied the same way as described in connection with FIG. 4. Afterwards the imaging means and the imaging object are separated from each other and the latter may be further processed to render the formed image to be detectible by various desired methods.

Figure 11:
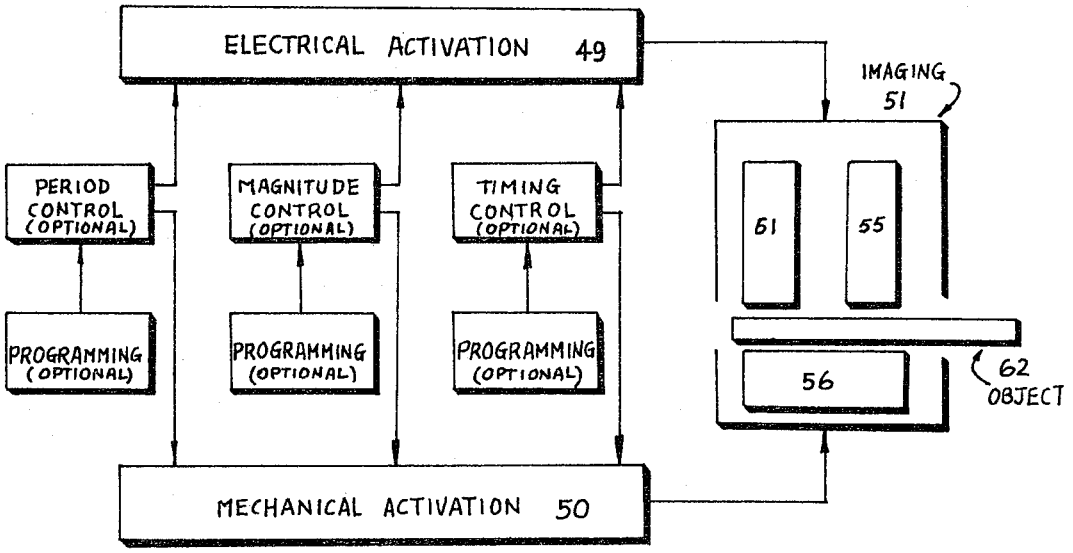
FIG. 11 is a block-schematic diagram of another preferred functional embodiment of the present invention.

The mechano-electrostatic imaging technique of the present invention permits the application of the electrical image-activating energy to the imaging object via imaging members positioned on the same side of the imaging object. FIG. 11 is a block diagram of another preferred functional embodiment of the present invention employing such an alterantive option, together with other optional arrangements for controlling the consequent charge density. 62 represents an imaging object of the nature described in connection with FIG. 10. 61 is a third imaging member function in the imaging function 51. 55 and 56 are respectively the first and second imaging functions as shown in FIG. 5. The two imaging functions 61 and 55 apply electrical image-activating energy on the same side of the imaging object 62. Imaging function 56 acts respectively with the other two imaging functions, i.e. functions 55 and 61, to apply mechanical image-activation. The mechanical image-activating energy is transmitted to the imaging object by motional displacement generated from the function 56, or from functions 55 and 61. After each activation, there appears on the imaging object 62 a pair of charge-images of opposite polarities, one being formed by the imaging function 61 and the other being formed by the imaging function 55. If it is desired to ignore the image of one polarity, we simply use an electrostatic detector which is sensitive to only the other polarity of charge or use pre-charged adhering material so that the material will adhere to the desired polarity of charge. Other methods are also available, one of which will be discussed in conjunction with FIG. 12. Reference numeral 54 represents the timing control function to the image-activation. Reference numeral 63 represents the control function to the magnitudes of the electrical and mechanical image activating energies. Reference numeral 64 represents the control function to the length of the image activating period of the imaging energies. Reference numerals 65, 66, and 67 represent respectively programming functions to the control functions 54, 63, and 64 so as to vary the settings of the latter in a pre-arranged fashion. The programming function may be realized with known prior art in the field of electronics or electromechanics employing circuitry, memory components and the like.

Figure 12:
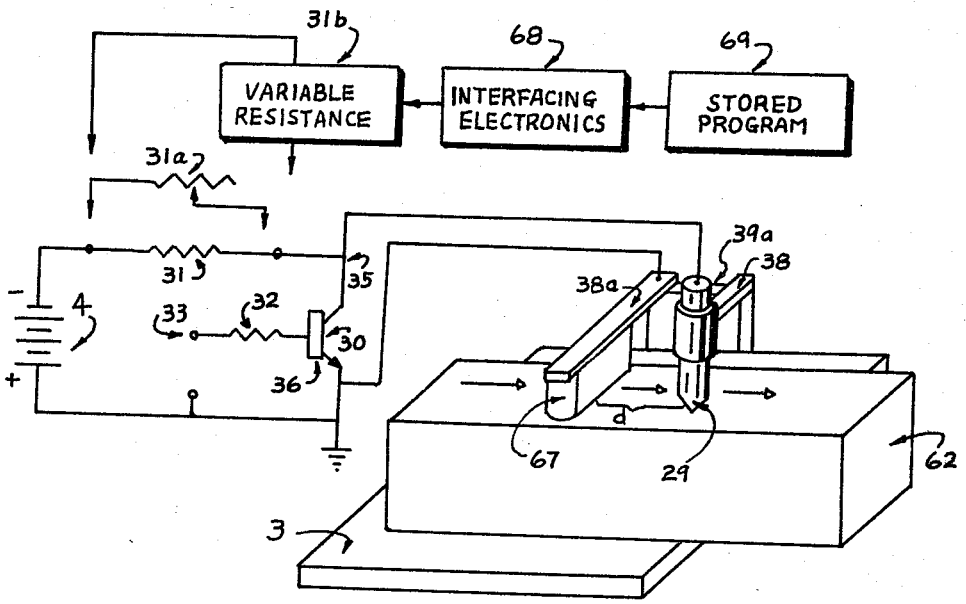
FIG. 12 is a semi-schematic drawing of a physical arramgement implementing the preferred functional embodiment of FIG. 11.

FIG. 12 shows a physical implementation of the functional embodiment shown in FIG. 11. It differs from that shown in FIG. 3A by employing a third imaging member 67 to perform the function 61 in FIG. 11. Imaging members 67 and 29 thus provide the electrical image activation while the imaging member 3 respectively with imaging members 67 and 29 provide the mechanical image-activation. Reference numeral 38*a* represents a pressure-generating means for the imaging member 67. Reference numeral 39*a* represents the supporting means between the pressure-generating means 38*a* and the imaging member 3. Both imaging members for the electrical image-activation, i.e. members 67 and 29, are now positioned on the same side of the imaging object 62. The separation d between the two electrical imaging members may have a value from several inches down to less than a thousandth of an inch depending on the design of the equipment and the nature of the imaging object. For an imaging object which has a charge-retaining surface with conductive backing underneath that surface, this physical separation can be much larger. When the imaging object is moving in a direction as shown by the arrow, it is first charged to one polarity by the imaging member 67 and then charged to the opposite polarity by the imaging member 29. Member 67 in this case is purposely made to charge with less charge density than does member 29. This can be done by employing a smaller mechanical imaging energy for member 67, i.e. a weaker pressure-generating member 38*a*, or by using a larger contacting surface between member 67 and imaging object 62, as shown in FIG. 12. With one or both these arrangements, there is a net charge in the locus made by member 29 to become the charge-image. At the same time, the charge of lower density and opposite polarity caused by member 67 serves as a background bias for a cleaner background.

31*a* is a variable restance which can be optionally used to replace the fixed resistance 31 so that the magnitude of the electrical image activation can be varied to control the charge density of the consequent charge-image. Another optional addition is to replace the fixed resistance 31 with the program-controlled resistance 31*b*. A stored-program means 69 contains the information concerning the desired value of the resistance 31*b* at various time of the imaging process thereby varying the charge density of the consequent image accordingly by thus controlling the magnitude of the electrical image-activating energy. 68 represents the electronics which reads the content of the stored program means 69 and accordingly varies the value of the resistance 31b to effect a change in the electrical image-activating energy.

Figure 13:
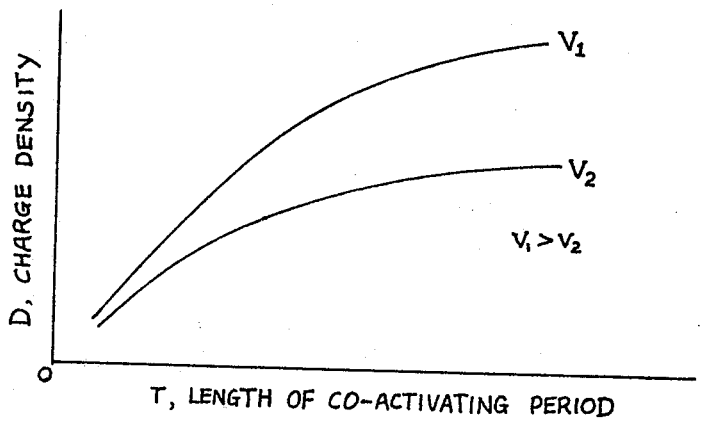
FIG. 13 is a graphic presentation depicting the effect of the length of the activating time on the charge density of the consequent image.

FIG. 13 shows qualitatively the functional relationship between the length of the activation period T and the consequent charge density D while the electrical and mechanical image-activating energies are held at their respective constant magnitudes. It is shown there that the charge density at first increases appreciably with the increase of the length of activation period, but later becomes less sensitive and stays at a somewhat constant level. By operating at the linear portion of the curve, it is thus possible to obtain a higher charge density by increasing the length of the activation period, or in other words, by decreasing the imaging speed.

While certain specific embodiments of the present invention have been disclosed as typical, the invention is of course not limited to these particular forms but rather is applicable broadly to such variations as fall within the scope of the appended claims. It will be understood that those skilled in the art that various changes in forms and details may be made without departing from the scope and spirit of the invention.

I claim:

1. The method of operating a charge-imaging system in its mechano-electrostatic imaging domain for forming charge-image on a charge-retaining imaging object with an imaging means capable of transmitting a mechanical image-activating energy and an electrical image-activating energy, and which comprises: positioning said imaging means and said imaging object in operative relationship; applying said mechanical image-activating energy in pre-set magnitude to said imaging object via said imaging means; applying said electrical image-activating energy, in magnitude within the range of operation of the mechano-electrostatic imaging domain of said system, to said imaging object via said imaging means; and controlling the timing of at least one of the said applications of the mechanical and of the electrical image-activating energies so that there is an overlapping time period during which both said image-activating energies act on a shared location of the said imaging object.

2. The method of claim 1, wherein the two said image-activating energies having their magnitudes pre-set for producing charge-image which has a desired level of charge density.

3. The method of claim 2, further comprises the varying of at least one of the pre-set magnitudes of the said electrical and said mechanical image-activating energies to cause the consequent charge-image to have a different level of charge density.

4. The method of claim 3, wherein the said varying of the pre-set magnitudes of said electrical and said mechanical image-activating energies is controlled in accordance with a pre-determined program, thereby the consequent charge-image has its level of charge density varied in accordance with said program.

5. The method of claim 1, further comprises the varying of the length of said time period during which both said image-activating energies act on the said imaging object, to cause the consequent charge-image to vary its level of charge density.

6. The method of claim 1, wherein the said electrical image-activating energy is applied to only one side of the said imaging object.

7. The method of claim 1, further comprises the preparing of the charge-image to be detectible by at least one of the magnetic, visual, thermal, tactile detecting methods by adhering to the charge-image electrostatically responsive material having an attribute of being detectable by at least one of the magnetic, visual, thermal, and tactile detecting methods.

8. A method of controlling the charge density of a charge image on a charge-retaining imaging object by operating a charge imaging system having means to simultaneously apply to a charge-imaging means a pre-set electrical image-activating energy and a pre-set mechanical image-activating energy to produce a mechano-electrostatic imaging domain, comprising the steps of pre-setting the magnitude of the mechanical image-activating energy, pre-setting the magnitude of the electrical image-activating energy, of positioning said imaging means and said imaging object in operative relationship, and of applying in a co-activating time period and to a shared common location on the said imaging object the two said image-activating energies via said imaging means.

9. The method of claim 8, further comprising the step of varying at least one of the pre-set magnitudes of the said electrical and mechanical image-activating energies to vary the level of charge density in the consequent charge-image.

10. The method of claim 9 wherein the said varying of the pre-set magnitudes of said electrical and said mechanical image-activating energies is controlled in accordance with a pre-determined program to control the consequent charge density of the charge-image in accordance with the said program.

11. The method of claim 8, further comprising the step of varying the length of said co-activating time period to vary the consequent charge density in the charge-image.

12. The method of claim 11, wherein the said varying of the co-activating time period is controlled in accordance with a pre-determined program to control the consequent charge density of the charge-image in accordance with the said program.

13. In the use of a charge-imaging system operable in the mechano-electrostatic domain employing both an electrical and a mechanical image-activating energy, the method of forming on a charge-retaining object a charge-image having a desired level of charge density using a pre-determined magnitude of electrical image-activating energy, comprising the steps of setting the electrical image-activating energy to said pre-determined magnitude, operating said charge-imaging system in its mechano-electrostatic imaging domain, varying the magnitude of said mechanical image-activating energy within its mechano-electrostatic imaging range, comparing the consequent level of charge density to the desired level of charge density, repeating the previous two steps until the consequent level of charge density is the same as the desired level of charge density.

14. The method of claim 13, further comprising the step of varying the length of the image-activating time period from the electrical and mechanical image-activating energies.

15. An apparatus for forming charge-image on a charge-retaining imaging object, comprising:

charge-imaging means capable of positioning in operative relationship with said imaging object and of transmitting to said imaging object an electrical image-activating energy and a mechanical image-activating energy within a shared time period, electrical activation means for supplying said electrical image-activating energy of a pre-set magnitude to said imaging object via said charge-imaging means, mechanical activation means for supplying said mechanical image-activating energy of a pre-set magnitude to said imaging object via said charge-imaging means, control means for controlling the application of at least one of the said electrical image-activating energy and said mechanical image-activating energy so that both energies act within an overlapping time period on a shared location of the said imaging object.

16. The apparatus of claim 15, further comprising means for controlling the magnitude of at least one of the two said image-activating energies within the mechano-electrostatic imaging range for changing the level of charge density of the consequent charge-image.

17. The apparatus of claim 15, further comprising means for stored-program control of the magnitude of at least one of the two said image-activating energies for controlling the charge density of the consequent charge-image in accordance with the said stored program.

18. The apparatus of claim 15, further comprising means for varying the length of said co-activating time period of the two image-activating energies for modifying the level of charge density of the consequent charge-image.

19. The apparatus of claim 15, further comprising means for stored program control of the length of the said co-activating period of time to control the charge density of the consequent charge-image in accordance with the said stored program.

20. The apparatus of claim 15, wherein said charge-imaging means further comprising an imaging member connecting to one polarity of the electrical image-activating energy, and another imaging member connecting to the other polarity of the said electrical image-activating energy, wherein both said imaging members are located on the same side of the said charge-retaining object for forming two charge-images of the opposite polarities, one each by the said imaging members.

21. The apparatus of claim 20, wherein the two said imaging members are subjected to different magnitudes of mechanical image-activating energy for producing different levels of charge density in the said two images of opposite polarities.

22. The apparatus of claim 20, wherein the two said imaging members having a difference in size for producing different levels of charge density to the respective said charge-images of opposite polarities.

23. The apparatus of claim 20, wherein the two said imaging members having a difference in shape for producing different levels of charge density to the respective said charge-images of opposite polarities.

24. In a charge-imaging system having a mechano-electrostatic boundary zone for its electrical image-activating energy, and apparatus for forming charge-image on a charge-retaining imaging object and for being capable of trading off the level of charge density of the formed charge-image for a lower magnitude of the activating electrical energy, comprising:

charge-imaging means capable of being in operative relationship with said imaging object and of transmitting to said imaging object an electrical image-activating energy and a mechanical image-activating energy within a shared time period, mechanical activation means for supplying said mechanical image activating energy of a pre-set magnitude to said imaging object via said charge-imaging means, electrical activation means for supplying said electrical image-activating energy at the desired magnitude below the said mechano-electrostatic boundary zone of said system, to said imaging object via said charge-imaging means, timing control means for controlling the application of at least one of the said electrical image-activating energy and said mechanical image-activating energy so that both energies act on said imaging object over a shared time period via said charge-imaging means.

* * * * *